US008646464B2

(12) United States Patent
Hampl, Jr. et al.

(10) Patent No.: US 8,646,464 B2
(45) Date of Patent: Feb. 11, 2014

(54) TREATED AREAS ON A WRAPPER FOR REDUCING THE IGNITION PROCLIVITY CHARACTERISTICS OF A SMOKING ARTICLE

(75) Inventors: Vladimir Hampl, Jr., Roswell, GA (US); James C. Rossi-Espagnet, Sayreville, NJ (US); Xiangwei Gu, Johns Creek, GA (US); Peter E. Brighenti, Canton, GA (US); Christopher Lee Goynes, Ball Ground, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 426 days.

(21) Appl. No.: 12/366,328

(22) Filed: Feb. 5, 2009

(65) Prior Publication Data

US 2009/0223529 A1 Sep. 10, 2009

Related U.S. Application Data

(60) Provisional application No. 61/030,740, filed on Feb. 22, 2008.

(51) Int. Cl.

| | |
|---|---|
| ***D21H 13/00*** | (2006.01) |
| ***D21H 15/00*** | (2006.01) |
| ***D21H 17/00*** | (2006.01) |
| ***D21H 19/00*** | (2006.01) |
| ***D21H 21/00*** | (2006.01) |
| ***D21H 23/00*** | (2006.01) |
| ***D21H 25/00*** | (2006.01) |
| ***D21H 27/00*** | (2006.01) |

(52) U.S. Cl.

USPC ..... 131/365; 131/360; 131/349; 131/347; 131/284; 162/139

(58) Field of Classification Search

None

See application file for complete search history.

(56) References Cited

U.S. PATENT DOCUMENTS

| | | | |
|---|---|---|---|
| 1,996,002 | A | 5/1933 | Seaman |
| 2,013,508 | A | 5/1933 | Seaman |

(Continued)

FOREIGN PATENT DOCUMENTS

| | | | |
|---|---|---|---|
| EP | 0262550 | A1 | 4/1988 |
| EP | 0193607 | B1 | 1/1989 |

(Continued)

OTHER PUBLICATIONS

Pulp and Paper Chemistry and Chemical Technology, Third Edition, vol. III by James P. Casey—Editor—A Wiley-Interscience Publication—pp. 1507-1521 & pp. 1702-1703.

(Continued)

*Primary Examiner* — Richard Crispino
*Assistant Examiner* — Phu Nguyen
(74) *Attorney, Agent, or Firm* — Dority & Manning, P.A.

(57) ABSTRACT

Smoking articles having reduced ignition proclivity characteristics are disclosed. The smoking articles include a paper wrapper containing cellulosic fibers and filler particles. The paper wrappers are formed so that the filler particles form a concentration gradient throughout the thickness of the wrapper. More particularly, a greater concentration of filler particles are present at a first surface in comparison to the amount of filler particles present at the opposite surface. In accordance with the present disclosure, an ignition reducing composition is applied to the first surface. In this manner, treated areas having more uniform properties are formed.

7 Claims, 3 Drawing Sheets

(56) References Cited

U.S. PATENT DOCUMENTS

| | | | |
|---|---|---|---|
| 2,776,912 | A | 1/1957 | Gregory |
| 3,215,579 | A | 11/1965 | Hagen |
| 3,511,247 | A | 5/1970 | Tamol |
| 3,526,904 | A | 9/1970 | Tamol |
| 3,699,973 | A | 10/1972 | Tamol et al. |
| 3,736,940 | A | 6/1973 | Saint-Pastou |
| 3,911,932 | A | 10/1975 | Houck, Jr. et al. |
| 3,949,762 | A | 4/1976 | West et al. |
| 4,077,414 | A | 3/1978 | Baker et al. |
| 4,129,134 | A | 12/1978 | Hind et al. |
| 4,146,040 | A | 3/1979 | Cohn |
| 4,222,740 | A | 9/1980 | Bohrn et al. |
| 4,267,240 | A | 5/1981 | Jaisle et al. |
| 4,303,084 | A | 12/1981 | Simon |
| 4,452,259 | A | 6/1984 | Norman et al. |
| 4,590,955 | A | 5/1986 | Dixit |
| 4,607,647 | A | 8/1986 | Dashley et al. |
| 4,615,345 | A | 10/1986 | Durocher |
| 4,622,983 | A | 11/1986 | Matthews et al. |
| 4,679,575 | A | 7/1987 | Yamaguchi et al. |
| 4,739,775 | A | 4/1988 | Hampl, Jr. |
| 4,784,164 | A | 11/1988 | Adams et al. |
| 4,805,644 | A | 2/1989 | Hampl, Jr. |
| 4,889,145 | A | 12/1989 | Adams et al. |
| 4,945,932 | A | 8/1990 | Mentzel et al. |
| 4,984,589 | A | 1/1991 | Riedesser |
| 4,998,542 | A | 3/1991 | Kallianos et al. |
| 5,057,606 | A | 10/1991 | Garbe |
| 5,092,353 | A | 3/1992 | Montoya et al. |
| 5,125,421 | A | 6/1992 | Mitchell |
| 5,131,416 | A | 7/1992 | Gentry |
| 5,143,098 | A | 9/1992 | Rogers et al. |
| 5,144,966 | A | 9/1992 | Washington |
| 5,170,807 | A | 12/1992 | Kasbo et al. |
| 5,178,167 | A | 1/1993 | Riggs et al. |
| 5,221,502 | A | 6/1993 | Washington |
| 5,261,425 | A | 11/1993 | Raker et al. |
| 5,263,999 | A | 11/1993 | Baldwin et al. |
| 5,271,419 | A | 12/1993 | Arzonico et al. |
| 5,417,228 | A | 5/1995 | Baldwin et al. |
| 5,474,095 | A | 12/1995 | Allen et al. |
| 5,540,242 | A | 7/1996 | Chao et al. |
| 5,690,787 | A | 11/1997 | Hultman et al. |
| 5,722,433 | A | 3/1998 | Ishino et al. |
| 5,820,998 | A | 10/1998 | Hotaling et al. |
| 5,849,153 | A | 12/1998 | Ishino et al. |
| 5,878,753 | A | 3/1999 | Peterson et al. |
| 5,878,754 | A | 3/1999 | Peterson et al. |
| 6,129,087 | A | 10/2000 | Wallace et al. |
| 6,568,403 | B2 | 5/2003 | Hampl, Jr. et al. |
| 6,606,999 | B2 | 8/2003 | Crooks et al. |
| 6,645,605 | B2 | 11/2003 | Hammersmith et al. |
| 6,725,867 | B2 | 4/2004 | Peterson et al. |
| 6,779,530 | B2 | 8/2004 | Kraker |
| 6,837,248 | B2 | 1/2005 | Zawadzki et al. |
| 6,854,469 | B1 | 2/2005 | Hancock et al. |
| 7,600,518 | B2 | 10/2009 | Oglesby et al. |
| 2002/0139381 | A1 | 10/2002 | Peterson et al. |
| 2002/0179105 | A1 | 12/2002 | Zawadzki et al. |
| 2002/0179106 | A1 | 12/2002 | Zawadzki et al. |
| 2003/0131860 | A1 | 7/2003 | Ashcraft |
| 2003/0164173 | A1 | 9/2003 | Zawadzki et al. |
| 2004/0011368 | A1 | 1/2004 | Tsutsumi et al. |
| 2004/0020502 | A1 | 2/2004 | Tosas Fuentes et al. |
| 2004/0084174 | A1 | 5/2004 | Ishikawa et al. |
| 2004/0094174 | A1 | 5/2004 | Ishikawa |
| 2004/0123874 | A1 | 7/2004 | Zawadzki et al. |
| 2004/0123966 | A1 | 7/2004 | Altman et al. |
| 2004/0182407 | A1 | 9/2004 | Peterson et al. |
| 2007/0084475 | A1 | 4/2007 | Oglesby |
| 2007/0137668 | A1 | 6/2007 | Borschke et al. |
| 2007/0169786 | A1 * | 7/2007 | Li et al. ..... 131/365 |
| 2007/0246055 | A1 | 10/2007 | Oglesby |
| 2007/0251658 | A1 | 11/2007 | Gedevanishvili et al. |
| 2008/0115794 | A1 | 5/2008 | Oglesby |
| 2009/0301506 | A1 | 12/2009 | Kida et al. |

FOREIGN PATENT DOCUMENTS

| | | | |
|---|---|---|---|
| EP | 0386884 | A2 | 9/1990 |
| EP | 0758532 | A | 2/1997 |
| EP | 0864259 | A2 | 9/1998 |
| GB | 848332 | | 8/1956 |
| JP | H1121795(A) | | 1/1999 |
| JP | 2004229541(A) | | 8/2004 |
| WO | 88/01478 | A | 3/1998 |
| WO | WO 02/067704 | | 9/2002 |
| WO | WO 02/078471 | | 10/2002 |
| WO | WO 2009105343 | | 8/2009 |

OTHER PUBLICATIONS

Kimberly-Clark, Product List of Cigarette Papers, 5 pages (Nov. 3, 1993).

Ecusta, Standard Products Catalog of Cigarette papers, 3 pages (Apr. 15, 1987).

Publication, "Relative Ignition Propensity of Test Market Cigarettes", Richard G. Gann, et al., National Institute of Standards and Technology, Technology Administration, U.S. Department of Commerce, Jan. 2001.

Publication, "The Effect of Cigarette Characteristics on the Ignition of Soft Furnishings", Richard G. Gann, et al., Center for Fire Research National Bureau of Standards, Oct. 1987.

Publication, "Overview: Practicability of Developing a Performance Standard to Reduce Cigarette Ignition Propensity", U.S. Consumer Product Safety Commission, Aug. 1993.

Publication, "Werkstoffe der Papierverarbeitung", Lehmann et al., Deutscher Fachverlag, Gmbh, Frankfurt (Main), 1979, pp. 110-115 (XP002529473).

Publication, "Rauigkeit als vernachlassigte Einflussgrosse der Druckqualitat", Steiger et al., Ugra Mitteilungen, (online) 2004, p. 34 (XP001418472).

Publication, "Determination of paper filler Z-distribution by low-vacuum SEM and EDX" Roux et al., Journal of Microscopy, (online) vol. 229, No. 1, Dec. 17, 2007, abstract.

Publication, "Determination of Paper Filler Z-distribution by Low Vacuum SEM and EDX", Roux et al., Journal of Microscopy, (online) vol. 229, No. 1, Dec. 17, 2007, pp. 44-45.

International Search Report PCT/US2007/012955, completed Oct. 23, 2007, mailed Oct. 30, 2007.

International Search Report PCT/US2009/033188, completed Feb. 5, 2009, mailed Aug. 28, 2009.

International Search Report PCT/US2008/069149, completed Jul. 3, 2008, mailed Jan. 5, 2009.

International Search Report PCT/US2008/069149, completed Jul. 3, 2008, mailed May 14, 2009.

Result of Duoformer—D Operations. Formation and Physical Properties of Woodfree Coating Base and Fine Paper from No. 2 PM of Nippon Kakoh Seishi K.K.

Information Offer Form, Submitted Mar. 7, 2013. (210-547679).

International Search Report PCT/JP2007/073502, Completed Mar. 11, 2008.

International Search Report PCT/JP02/04650, Completed Jul. 16, 2002.

Pulp and Paper Chemistry and Chemical Technology, Third Edition, vol. 2, by James P. Casey.

* cited by examiner

TREATED AREAS ON A WRAPPER FOR REDUCING THE IGNITION PROCLIVITY CHARACTERISTICS OF A SMOKING ARTICLE

RELATED APPLICATIONS

The present application is based upon and claims priority to U.S. Provisional Patent Application No. 61/030,740, filed on Feb. 22, 2008.

BACKGROUND

There is an ongoing concern in the tobacco industry to produce cigarettes having wrappers which reduce the ignition proclivity of the smoking article, or the tendency of the smoking article to ignite surfaces which come into contact with the lit smoking article. Reports have been made of fires attributed to burning cigarettes coming into contact with combustible materials. A justifiable interest exists in the industry to reduce the tendency of cigarettes, or other smoking articles to ignite surfaces and materials used in furniture, bedding, and the like upon contact.

Thus, a desirable feature of smoking articles, particularly cigarettes, is that they tend to self-extinguish upon being dropped or left in a free burning state on combustible materials.

It has long been recognized in the tobacco industry that the cigarette wrapper can have a significant influence on the smolder characteristics of the cigarette. In this regard, various attempts have been made in the art to alter or modify the cigarette wrappers in order to achieve the desired tendency of the cigarette to self-extinguish, or in other words to reduce the ignition proclivity characteristics of cigarettes.

The prior art describes the application of film-forming solutions to cigarette paper to reduce the paper permeability and control the burn rate. It has been shown that when these materials have been applied in discrete areas along the length of the cigarette, the cigarette shows a reduced propensity to ignite a substrate and tends to self-extinguish.

U.S. Pat. No. 5,878,753 to Peterson, U.S. Pat. No. 5,820,998 to Hotaling, et al., U.S. Pat. No. 6,779,530 to Kraker, and U.S. Pat. No. 6,725,867 to Peterson, which are incorporated herein by reference, for example, describe a smoking article wrapper being treated with a film-forming solution to reduce ignition proclivity. U.S. Pat. No. 5,878,754 to Peterson which is also incorporated herein by reference describes a smoking article wrapper being treated with a non-aqueous solution of a solvent soluble polymer dissolved in a non-aqueous solution to reduce ignition proclivity.

Although many improvements have been made in the art, there is still a need for an improved method for producing a smoking article with reduced ignition proclivity properties. For example, one challenge that has been facing manufacturers has been the ability to create the discrete areas with uniform properties. In this regard, a need currently exists for a process for forming treated areas on a paper wrapper in which the treated areas on each wrapper and the treated areas from wrapper to wrapper do not vary substantially in their properties and characteristics. A process capable of controlling the properties of the treated areas will lead to the formation of smoking articles having more predictable burning characteristics.

SUMMARY

The present disclosure is generally directed to paper wrappers for smoking articles with reduced ignition proclivity and to a process for producing the wrappers.

For example, in one embodiment, the paper wrapper can be made from cellulosic fibers and filler particles. The cellulosic fibers, for instance, may comprise flax fibers, softwood fibers, hardwood fibers, and mixtures thereof. The filler particles, on the other hand, can comprise any suitable filler particles, such as calcium carbonate or a metal oxide, such as magnesium oxide and/or titanium dioxide. The filler particles may be present in the paper wrapper in an amount from about 10% to about 50% by weight, such as from about 20% to about 40% by weight.

The paper wrapper includes a first surface and a second and opposite surface. In accordance with the present disclosure, the paper wrapper is formed so that the filler particles form a concentration gradient over a thickness of the paper wrapper. Specifically, a greater concentration of filler particles is present at the first surface in comparison to the concentration of filler particles present at the second surface. For instance, in one embodiment, greater than about 65% by weight, such as greater than about 75% by weight, such as greater than about 80% by weight of the filler particles are contained in the wrapper between a middle of the wrapper and the first surface. In this manner, the first surface is generally smoother than the second surface. For instance, the first surface can have a Sheffield smoothness of less than about 600, such as less than about 550, such as less than about 500, such as less than about 450, such as less than about 400, such as less than about 350, such as less than about 300, such as less than about 250, such as less than about 200.

At least one treated area is located on the first surface of the paper wrapper. The treated area comprises an ignition reducing composition that reduces the ignition proclivity characteristics of a smoking article incorporating the paper wrapper. The ignition reducing composition can contain, for instance, a film-forming material such as an alginate, guar gum, pectin, a polyvinyl alcohol, a cellulose derivative, starch, a starch derivative, or mixtures thereof.

By forming the treated areas on the surface of the paper wrapper having the greater concentration of filler particles, various benefits and advantages may be obtained. For example, the presence of the filler particles can create a smoother surface which provides a better surface for receiving the ignition reducing composition especially during a printing process. Ultimately, treated areas are formed having more uniform properties. For instance, the treated areas may have a porosity coefficient of variation of less than about 27%, such as less than about 25%, such as less than about 23%, such as even less than about 20%.

The treated areas can also have a relatively high average porosity. For instance, the porosity within the bands can be greater than about 16 Coresta, such as greater than about 20 Coresta, such as greater than about 24 Coresta.

Unexpectedly, it has also been discovered that in some applications, smoking articles incorporating paper wrappers made according to the present disclosure have reduced carbon monoxide delivery. For instance, in one embodiment, smoking articles made according to the present disclosure may have a carbon monoxide delivery of less than about 15.5 mg, such as less than about 15 mg, such as less than about 14 mg.

The treated areas formed on the paper wrapper can have a Burn Mode Index of less than about 5 $cm^{-1}$, such as less than about 3 $cm^{-1}$. Smoking articles incorporating the paper wrapper can have an ASTM Test Number E2187-04 pass rating of at least about 75%, such as at least about 90%. The smoking articles can also have a "free air self-extinguishment" (FASE) rating of less than about 50%, such as less than about 25%.

The present disclosure is also directed to a process for forming a paper wrapper for a smoking article. The process includes the steps of forming a paper web from an aqueous suspension of cellulosic fibers and filler particles. The aqueous suspension is deposited onto at least one foraminous surface and drained in a manner so that the filler particles form a concentration gradient over a thickness of the paper web. For instance, the paper web can include a first surface and a second surface. The second surface during formation of the web can face the foraminous surface. After draining, a greater concentration of filler particles may be present at the first surface in comparison to the concentration of filler particles at the second surface. If desired, draining can occur under a suction force which may also assist in forming the concentration gradient of the filler particles.

Once the paper web is formed, the web can be dried and an ignition reducing composition can be applied to discrete areas on the paper wrapper. The web can be dried, for instance, by being passed over one or more heated drums. The ignition reducing composition can be applied to the paper wrapper using any suitable technique, such as printing or spraying. When printed onto the paper wrapper, the composition can be applied using a flexographic printer or a gravure printer.

Other features and aspects of the present disclosure are discussed in greater detail below.

BRIEF DESCRIPTION OF THE DRAWINGS

A full and enabling disclosure of the present disclosure, including the best mode thereof to one skilled in the art, is set forth more particularly in the remainder of the specification, including reference to the accompanying figures, in which.

Figure 1:
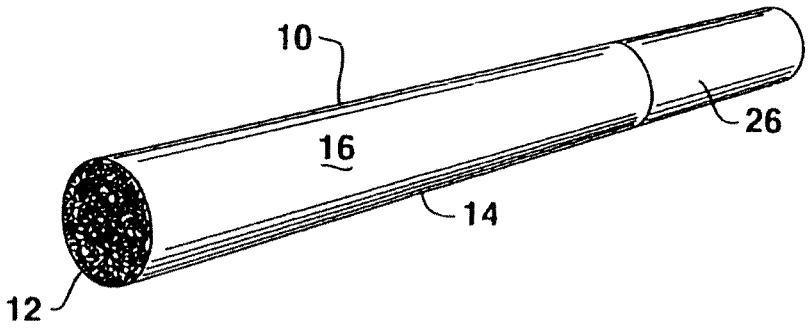
FIG. 1 is a perspective view of a smoking article made in accordance with the present disclosure.

Repeat use of reference characters in the present specification and drawings is intended to represent the same or analogous features or elements of the present invention.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations.

For purposes of explanation of the invention, the embodiments and principles of the invention will be discussed in regards to a cigarette. However, this is for the purposes of explanation of the invention only and is not meant to limit the invention only to cigarettes. Any manner of smoking article is within the scope and spirit of the invention.

The present disclosure relates to a smoking article, and a wrapper for a smoking article, having improved ignition proclivity control characteristics. "Ignition proclivity" is a measure of the tendency of the smoking article or cigarette to ignite a flammable substrate if the burning cigarette is dropped or otherwise left on a flammable substrate. A test for ignition proclivity of a cigarette has been established by NIST (National Institute of Standards and Technology) and is generally referred to as the "Mock-Up Ignition Test". The test comprises placing a smoldering cigarette on a flammable test fabric and recording the tendency of the cigarette to either ignite the test fabric, burn the test fabric beyond a normal char line of the fabric, burn its entire length without igniting the fabric, or self-extinguish before igniting the test fabric or burning its entire length.

Another test for ignition proclivity is referred to as the "Cigarette Extinction Test". The Cigarette Extinction Test is ASTM Test No. E2187-04 using 10 layers of filter paper. In the Cigarette Extinction Test, a lit cigarette is placed on 10 layers of filter paper. If the cigarette self extinguishes, the cigarette passes the test. If the cigarette burns all the way to its end on the filter, however, the cigarette fails. Smoking articles made in accordance with the present invention can be designed to pass one or both of these tests.

In addition to the above tests, smoking articles having reduced ignition proclivity cigarettes are typically also tested for "free air self-extinguishment" (FASE). During the free air extinguishment test, the smoking articles are allowed to burn in the free air (within a fume hood while being held by a pin) without being puffed and without being placed on an adjacent surface. In most applications, it is desirable for a smoking article to pass the mock up ignition test or the cigarette extinction test while not self-extinguishing when left burning in the free air. Thus, lower FASE rates are preferred. Of particular advantage, smoking articles constructed in accordance with the principles of the present invention may be configured to self extinguish when placed on an adjacent surface but yet have relatively low FASE rates.

In the past, the assignee of the present application has obtained various patents directed to smoking articles with reduced ignition proclivity characteristics. For example, paper wrappers treated with a film-forming composition that forms treated discrete areas on the wrapper are disclosed in U.S. Pat. Nos. 6,779,530 and 6,725,867, which are both incorporated herein by reference.

In both the '530 patent and in the '867 patent, the film-forming composition is described as, in one embodiment, being applied as circumferential cross-directional bands. The bands are spaced apart from each other on the cigarette wrapper along the length of the cigarette. Both patents discuss applying the film-forming composition to an outside surface of the paper wrapper or to an inside surface of the paper wrapper so that the treated areas are adjacent to a tobacco filler.

In most commercial applications, however, the treated areas have been applied to the inside surface of the paper wrapper. The bands have been applied to the inside surface in order to reduce their visibility. The present inventors have discovered, however, that various benefits and advantages can be obtained if the treated areas are applied to the side of the paper wrapper that forms the exterior surface of the smoking article as will be described in greater detail below.

The present disclosure is also directed to the construction of a paper wrapper that is particularly well suited to receiving an ignition reducing composition, such as a film-forming composition. In particular, the paper wrappers contain cellulosic fibers in combination with one or more fillers. In accordance with the present disclosure, the fillers are incorporated into the paper wrapper so that the filler particles form a concentration gradient across the thickness of the wrapper. Thus, a paper wrapper is formed that has a greater concentration of filler particles at a first surface as opposed to the concentration of filler particles at an opposite surface. By having a relatively high concentration of filler particles at the first surface, the first surface is generally smoother than the opposite surface and thus better suited to receiving an ignition reducing composition for forming treated areas on the wrapper.

For instance, the present inventors have discovered that by applying an ignition reducing composition to a surface of a paper wrapper having a relatively high concentration of filler particles, the characteristics and the properties of the treated areas on the wrapper can be better controlled. Further, more uniform properties can be obtained within each treated area and more uniform properties can be obtained from treated area to treated area. By improving the uniformity of the treated areas, smoking articles incorporating the paper wrappers exhibit more predictable results when tested for reduced ignition proclivity and for free air self-extinguishment.

For example, treated areas made according to the present disclosure have shown an improved porosity coefficient of variation. In particular, treated areas made according to the present disclosure can have a porosity coefficient of variation of less than about 30%, such as less than about 27%, such as less than about 25%, such as less than about 23%, and, in one embodiment, even less than about 21%.

The treated areas applied to the present disclosure can be applied to the inside surface of the paper wrapper so that the treated areas face a tobacco filler contained within the smoking article. Alternatively, the treated areas can be formed on the paper wrapper so as to be located on an exterior surface of the smoking article. In fact, as mentioned above, various other benefits and advantages can be obtained if the treated areas are applied to the exterior surface.

For example, many ignition reducing compositions, such as film forming materials including alginates, thermally degrade at higher temperatures. When the treated areas are located on an exterior surface of the smoking article, however, the treated areas are exposed to lower temperatures than if the treated areas are positioned on the inside surface of the smoking article. When exposed to higher temperatures, the ignition reducing composition may have a tendency to thermally degrade faster and to decrease in effectiveness. By positioning the treated areas on the exterior surface of the smoking article, however, the treated areas may be exposed to lower temperatures and thus have greater effectiveness in self-extinguishing the smoking article should the smoking article be left on an adjacent surface. For instance, it is believed that the temperature difference between the inside surface of the paper wrapper and the outside surface of the paper wrapper can be over 150° F. as the smoking article burns.

The present inventors have also unexpectedly discovered that positioning the treated areas on the outside surface of the paper wrapper actually leads to lower carbon monoxide levels in the mainstream smoke. Although unknown, it is believed that the diffusivity of gases through the paper wrapper is increased if the treated areas are applied to the outside surface of the wrapper as opposed to being applied to the inside surface of the wrapper. By having a higher diffusivity, greater amounts of carbon monoxide may escape through the wrapper instead of being inhaled as the smoking article is puffed.

For example, cigarettes made in accordance with the present disclosure can have a carbon monoxide delivery in the mainstream smoke of less than about 15.5 mg, such as less than about 15 mg, such as less than about 14.5 mg, such as even less than about 14 mg. In other words, by applying the ignition reducing composition to the outside surface of the paper wrapper, carbon monoxide delivery can be decreased by greater than about 5%, such as greater than about 10% in comparison to applying the ignition reducing composition to an interior surface of the paper wrapper.

Generally, paper wrappers made according to the present disclosure contain cellulosic fibers in combination with filler particles. The cellulosic fibers can be, for instance, flax fibers, softwood fibers, hardwood fibers, or mixtures thereof. In order to vary the properties of the paper web as desired, various mixtures of cellulosic fibers can be used and the extent to which the fibers are refined can also be varied.

The filler particles incorporated into the paper web can vary depending upon the particular application. In general, any suitable filler may be used. The filler can be, for instance, calcium carbonate particles or metal oxide particles. Suitable metal oxide particles include magnesium oxide particles or titanium dioxide particles. The total filler loading added to the paper web can be from about 10% by weight to about 50% by weight, such as from about 20% by weight to about 40% by weight.

In order to form a concentration gradient of the filler particles across the thickness of the paper wrapper, any suitable technique or process may be used. In one embodiment, for instance, the paper wrapper can be formed in a wet-laid papermaking process. During formation of the paper wrapper, the wrapper can be subjected to various forces causing a desired filler particle concentration gradient to form.

Figure 3:
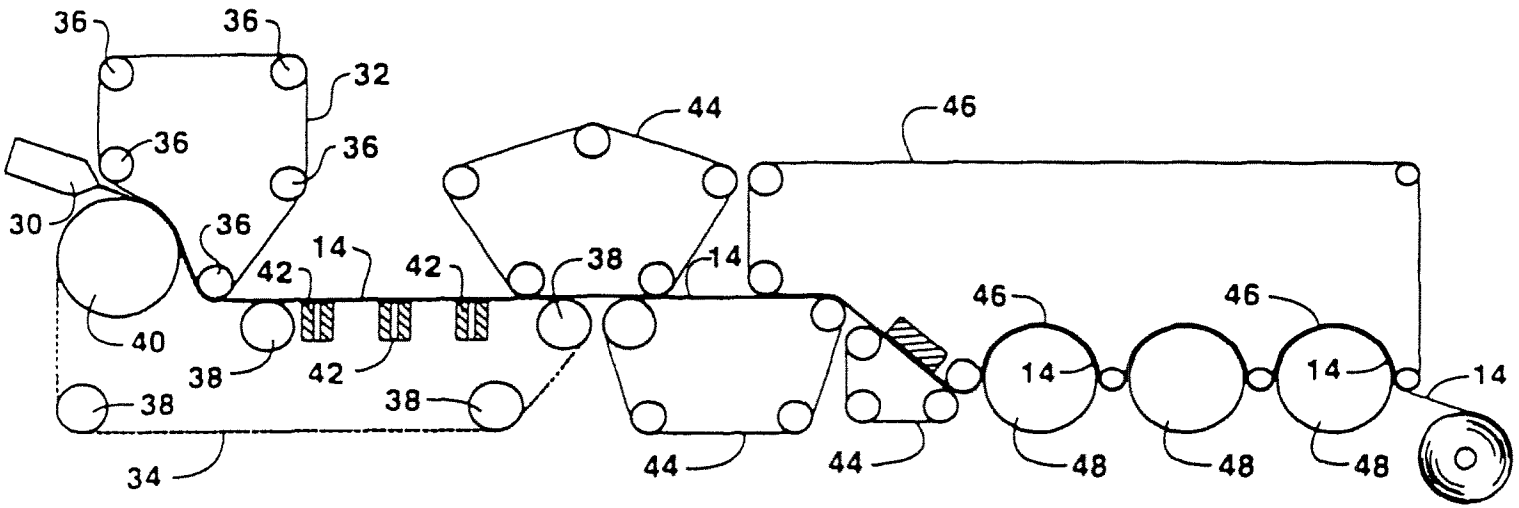
FIG. 3 is a side view of the one embodiment of a process for producing a paper web in accordance with the present disclosure.

For example, referring to FIG. 3, one exemplary embodiment of a papermaking system that may be used in accordance with the present disclosure is shown. As illustrated, the papermaking system includes a headbox 30 configured to receive a dilute aqueous suspension of cellulosic fibers and filler particles. The headbox 30 is configured to inject the aqueous suspension in between a first foraminous surface 32 and a second foraminous surface 34. As shown, the first foraminous surface 32 and the second foraminous surface 34 may comprise endless traveling conveyors. The conveyors may comprise fabrics, felts, or mixtures thereof.

The foraminous surface 26 is supported and driven by a plurality of rolls 36. The foraminous surface 34, on the other hand, is supported and driven by a plurality of rolls 38. The speed at which the foraminous surface 32 is driven in relation to the foraminous surface 34 can depend upon the particular application. In one embodiment, for instance, the speed of the first foraminous surface 32 can be approximately the same as the speed of the second foraminous surface 34.

The foraminous surfaces 32 and 34, as described above, can be made from any suitable porous material, such as fabrics and/or felts. When constructed from a fabric, the fabric can comprise metal wires or polymeric filaments. Felts, on the other hand, generally comprise nonwoven base layers. In one embodiment, for instance, the foraminous surface 34 may comprise a felt for providing a relatively smooth surface for forming the paper wrapper.

As shown in FIG. 3, once the aqueous suspension of fibers and filler particles is injected between the first foraminous surface 32 and the second foraminous surface 34, the aqueous suspension travels around the circumference of a forming roll 40. The forming roll 40 is optional but, when present, comprises a drainage roll that allows water to drain out of the aqueous suspension. In one embodiment, the forming roll 40 can comprise a vacuum roll that applies a suction force to the aqueous suspension in order to form a paper web 14.

After the forming roll 40, the first foraminous surface 32 separates and diverges from the second foraminous surface 34. The paper web 14 is further conveyed downline solely on the foraminous surface 34. As shown in FIG. 3, while on the foraminous surface 34, the paper web 14 is placed adjacent to one or more vacuum devices 42. For instance, as shown in the Figure, the papermaking system includes three vacuum devices. It should be understood, however, that more or less vacuum devices may be included.

The vacuum devices 42 apply a suction force to the paper web 14 and further drain the web through the foraminous surface 34. In accordance with the present disclosure, the vacuum devices 42 in conjunction with the forming roll 40 cause the filler particles to form a concentration gradient within the paper web 14. In particular, in addition to water, the side of the paper web 14 facing the foraminous surface 34 becomes deficient in filler particles and fines. Thus, a lesser amount of filler particles are present on the surface of the paper web 14 facing the foraminous surface 34. A greater concentration of filler particles, on the other hand, is present on the surface of the paper web 14 that faces away from the foraminous surface 34.

After the paper web 14 is drained of water, the paper web is further conveyed downstream and dried. If desired, one or more transfer fabrics or felts 44 may be present in the process. Ultimately, the paper web 14 is contacted with a drying fabric 46 and dried. The paper web can be dried according to any suitable process. In the embodiment illustrated in FIG. 3, for instance, the paper web 14 is contacted with one or more heated drums 48. In FIG. 3, for instance, three heated drums 48 are shown in series. It should be understood, however, that more or less heated drums may be used. The drums can be heated using any suitable energy source. For instance, the drums can be heated through electrical resistance or by circulating a hot fluid within the drum, such as steam. The one or more heated drums 48 substantially dry the paper web 14.

As described above, through the process illustrated in FIG. 3, a concentration gradient of the filler particles is formed over a thickness of the paper web. For instance, in one embodiment, greater than about 65% by weight of the filler particles are contained in the paper wrapper between a middle of the wrapper and the surface of the wrapper that faces away from the foraminous surface 34. In other embodiments, greater than about 70%, such as greater than about 75% by weight of the filler particles are contained in the wrapper between the middle of the wrapper and the surface not in contact with the foraminous surface 34. Once the paper web is formed, in accordance with the present disclosure, an ignition reducing composition is then applied to the surface of the paper wrapper containing the greater amount of filler particles.

Of particular advantage, the surface of the paper wrapper containing a greater amount of filler particles is generally smoother than the opposite surface. For instance, the surface containing the greater concentration of filler particles can have a Sheffield smoothness that is at least about 2% smoother, such as at least about 4% smoother, such as at least about 6% smoother, such as at least about 8% smoother, such as at least about 10% smoother than the opposite surface. The smoother surface is better adapted to receiving the ignition reducing composition, especially when the composition is printed onto the paper. Ultimately, the smoother surface results in more uniform properties of the treated areas.

Paper wrappers made according to the present disclosure can have any suitable permeability and basis weight as desired based upon the particular application. The permeability of the paper wrapper, for instance, can generally be from about 10 Coresta units to about 200 Coresta units. In some applications, the permeability can be between about 15 Coresta units to about 55 Coresta units. In one embodiment of the present invention, however, the initial permeability of the paper wrapper is relatively high. For instance, in one embodiment, the permeability of the paper wrapper can be from about 60 Coresta units to about 110 Coresta units. In various embodiments, for example the initial permeability of the paper wrapper may be greater than about 70 Coresta units, greater than about 80 Coresta units, greater than about 90 Coresta units, or greater than about 100 Coresta units.

The basis weight of cigarette wrapping paper is usually between about 18 gsm to about 60 gsm, and more particularly between about 15 gsm to about 40 gsm. Wrapping papers according to the present invention can be made within any of these ranges.

Once the paper web 14 as shown in FIG. 3 is formed, an ignition reducing composition may be applied to one side of the web. For instance, in one embodiment, an ignition reducing composition can be applied to discrete areas of the web which reduce the ignition proclivity characteristics of a smoking article incorporating the web.

In general, any suitable ignition reducing composition can be applied to the paper web 14. In one embodiment, for instance, the ignition reducing composition contains a film-forming material. For example, film-forming materials that can be used in accordance with the present invention include alginates, guar gum, pectin, polyvinyl alcohol, polyvinyl acetate, cellulose derivatives such as ethyl cellulose, methyl cellulose, and carboxymethyl cellulose, starch, starch derivatives, and the like.

In one particular embodiment, the film-forming material may comprise an alginate. In general, an alginate is a derivative of an acidic polysaccaride or gum which occurs as the insoluble mixed calcium, sodium, potassium and magnesium salt in the Phaeophyceae brown seaweeds. Generally speaking, these derivatives are calcium, sodium, potassium, and/or magnesium salts of high molecular weight polysaccarides composed of varying proportions of D-mannuronic acid and L-guluronic acid. Exemplary salts or derivatives of alginic acid include ammonium alginate, potassium alginate, sodium alginate, propylene glycol alginate, and/or mixtures thereof.

In one embodiment, a relatively low molecular weight alginate may be used. For example, the alginates may have a viscosity of less than about 500 cP when contained in a 3% by weight aqueous solution at 25° C. More particularly, the alginates may have a viscosity of less than 250 cP at the above conditions, particularly less than 100 cP, and in one embodiment at a viscosity of about 20-60 cP. As used herein, viscosity is determined by a Brookfield LVF Viscometer. Commercially available alginates that may be used include KELGIN RL, MANUCOL LD AND MANUCOL LB, which are all commercially available from the ISP Corporation, which is part of the FMC Corporation.

At the above lower viscosity levels, alginate compositions can be formed at a higher solids content, but yet at a low enough solution viscosity to permit the application of the composition to a paper wrapper using conventional techniques. For example, the solids content of an alginate solution made in accordance with the present invention can be greater than about 6%, particularly greater than about 10%, and more particularly from about 10% to about 20% by weight.

At the above solids levels, alginate compositions used in accordance with the present invention can have a solution viscosity of greater than about 250 cP, particularly greater than about 500 cP, more particularly greater than about 800 cP, and in one embodiment at a viscosity of greater than about 1,000 cP at 25° C. In general, the solution viscosity of the alginate film-forming composition can be adjusted depending upon the manner in which the composition is being applied to the paper. For instance, the solution viscosity of the composition can be adjusted depending upon whether or not the composition is being sprayed onto the paper or printed onto the paper.

In other embodiments, it should also be understood that depending upon the application a relatively high molecular weight alginate may be used. For example, the alginate may have a viscosity of greater than about 500 cP when contained in a 3% by weight aqueous solution at 25° C.

In addition to one or more film-forming materials, the ignition reducing composition can also contain a burn promoting agent if desired. Examples of burn promoting agents include alkali metal salts, alkaline earth metal salts, and mixtures thereof. In one embodiment, the burn promoting agent may comprise a salt of a carboxylic acid. In particular examples, for instance, the burn promoting agent may comprise an acetic acid salt, a citric acid salt, a malic acid salt, a lactic acid salt, a tartaric acid salt, a carbonic acid salt, a formic acid salt, a propionic acid salt, a glycolic acid salt, a fumaric acid salt, an oxalic acid salt, a malonic acid salt, a succinic acid salt, a nitric acid salt, a phosphoric acid salt, and mixtures thereof. In one particular application, for instance, the burn promoting agent may comprise potassium citrate, sodium citrate, potassium succinate, sodium succinate, or mixtures thereof.

In addition to the film-forming material and the burn promoting agent, the film-forming composition applied to the paper wrapper can contain various other ingredients.

For instance, in one embodiment, a filler can be contained within the composition. The filler can be, for instance, calcium carbonate, calcium chloride, calcium lactate, calcium gluconate, and the like. In addition to calcium compounds, other various particles may be used including magnesium compounds such as magnesium oxide, clay particles, and the like.

In still another embodiment, a burn retardant may also be present in the ignition reducing composition. A suitable burn retardant, for instance, may comprise a phosphate of ammonium, such as diammonium phosphate. Other burn retardants are described in U.S. Pat. No. 6,837,248, which is incorporated herein by reference.

The ignition reducing composition, in one embodiment, can be water based. In particular, the ignition reducing composition may comprise an aqueous dispersion or aqueous solution. Alternatively, the ignition reducing composition prior to being applied to the paper wrapper may comprise a non-aqueous solution or dispersion. In this embodiment, for instance, an alcohol may be present for applying the composition to the wrapper.

Once the ignition reducing composition is formulated, the composition can be applied to a paper wrapper in discrete areas. The manner in which the composition is applied to the paper wrapper can vary. For example, the composition can be sprayed, brushed or printed onto the wrapper. To form a treated area, the composition can be applied in a single pass or in a multiple pass operation. For instance, the composition can be applied to the wrapping paper in successive steps in order to form areas on the paper having reduced ignition proclivity. In general, during a multiple pass process, the treated areas can be formed by applying the composition during from about 2 to about 8 passes.

In addition to the ignition reducing composition, the paper wrapper can also be treated with various other agents. For example, in one embodiment, a burn-promoting agent as described above may be applied over substantially the entire surface area of the wrapping paper. The burn promoting agent may be applied before or after the ignition reducing composition is applied to the paper wrapper. For example, the burn promoting agent may be applied uniformly over the surface area of the paper wrapper in an amount from about 0.3% to about 5% by weight, such as from about 0.3% to about 2.5% by weight.

Figure 2:
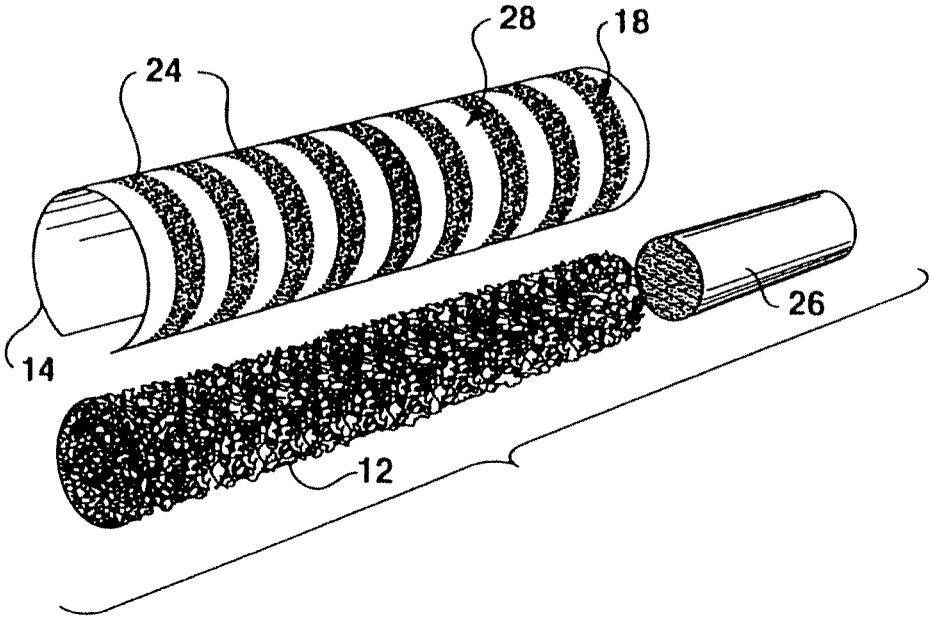
FIG. 2 is an exploded view of the smoking article illustrated in FIG. 1.

In order to assist in describing and explaining the present invention, one embodiment of a smoking article in accordance with the present disclosure is illustrated generally in FIGS. 1 and 2. A smoking article (cigarette), generally 10, having improved ignition proclivity characteristics includes a tobacco column 12 within a wrapper 14. Article 10 may include a filter 26.

Paper web 14 defines an outer circumferential surface 16 when wrapped around tobacco column 12. Discrete areas 18 of outer circumferential surface 16 are treated with the ignition reducing composition. It should also be understood that treated areas 18 could also be disposed on the inner surface of wrapper 14. In other words, wrapper 14 could be rolled around tobacco column 12 so that treated areas 18 are adjacent to the tobacco.

As described above, however, various advantages and benefits may be obtained if the treated areas are located on an exterior surface of the smoking article. For instance, it has been found that applying the treated areas to the exterior surface of the smoking article can reduce the amount of carbon monoxide in the mainstream smoke. Further, depending upon the ignition reducing composition, applying the composition to the exterior surface can better preserve the effectiveness of the composition in reducing the ignition proclivity characteristics of the smoking article. For instance, the present inventors have found that the treated areas are exposed to lower temperatures as the smoking article burns if the treated areas are on the exterior surface of the paper wrapper. Exposing the treated areas to lower temperatures can prolong the thermal degradation of the ignition reducing composition.

For example, alginate is known to thermally degrade at a temperature that is about 70° F. lower than the temperature at which cellulose burns. As the smoking article is burning, the hot coal approaches the treated areas and the alginate begins to thermally degrade, which reduces the effectiveness of the treated areas. Placing the ignition reducing composition on the exterior surface of the smoking article, on the other hand, can expose the treated areas to reduced temperatures allowing the treated areas to remain effective for a longer period of time and therefore providing better reduced ignition proclivity characteristics.

In the embodiment illustrated in FIGS. 1 and 2, treated areas 18 are defined as circumferential cross-directional bands 24. Bands 24 are spaced apart from each other longitudinally along the length of cigarette 10. The bands 24 are indicated in phantom in FIG. 2. However, it should be understood that the treated areas can be essentially invisible in the formed cigarette as shown in FIG. 1. In other words, a smoker may not discern from any outward sign that the wrapper 14 has been treated in discrete areas 18. In this regard, treated areas 18 can have a smooth and flat texture essentially the same as untreated areas 28.

The width and spacing of bands 24 are dependent on a number of variables, such as the initial permeability of wrapper 14, density of tobacco column 12, etc. The bands 24 preferably have a width so that oxygen is limited to the burning coal for a sufficient length or period of time to extinguish the coal. In other words, if band 24 were too narrow, the burning coal would burn through band 24 before self-extinguishing. For most applications, a minimum band width of 3 mm is desired. For example, the band width can be from about 4 mm to about 10 mm.

The spacing between bands 24 is also a factor of a number of variables. The spacing should not be so great that the cigarette burns for a sufficient length of time to ignite a substrate before the coal ever burns into a treated area 18. The spacing between bands 24 also affects the thermal inertia of the burning coal, or the ability of the coal to burn through the treated bands 24 without self-extinguishing. In the cigarettes tested, applicants have found that a band spacing of between 5 and 50 mm is appropriate and particularly between about 10 mm and 40 mm. However, it should be understood that the band spacing can be any suitable width as determined by any number of variables. For most applications, the smoking article can contain from 1 to about 3 bands using the above spacing.

The permeability of the treated areas 18 can vary depending upon various factors including the base permeability of the paper wrapper and the type of ignition reducing composition that is used. In some applications, it may be desirable to have the permeability of the treated areas to be as high as possible so that a smoker does not discern a difference in taste or other characteristics when the smoking article is puffed and the advancing coal burns through the treated areas. Of particular advantage, since the properties of the treated areas can be accurately controlled according to the present process, the permeability of the treated areas can be relatively high while still providing the smoking article with adequate reduced ignition proclivity properties. For instance, the treated areas can have a permeability of greater than about 15 Coresta, such as greater than about 18 Coresta, such as greater than about 20 Coresta, such as even greater than about 24 Coresta.

One measurement that can be used to indicate reduced ignition proclivity properties is Burn Mode Index. In fact, the Burn Mode Index of a paper wrapper can be more accurate in indicating the burning characteristics of a paper as opposed to simply measuring the permeability of the paper. The test for determining Burn Mode Index is explained in U.S. Pat. No. 4,739,775 to Hampl, which is incorporated herein by reference.

In order to exhibit reduced ignition proclivity properties, the Burn Mode Index ("BMI") of the treated areas 18 can be generally less than about 8 $cm^{-1}$, and particularly less than about 5 $cm^{-1}$. For instance, in one embodiment, the burn mode index of the treated areas 18 can be from about 1 $cm^{-1}$ to about 3 $cm^{-1}$.

The amount of composition that is added to the paper will depend upon various factors, including the type of composition that is used and the desired result. For most applications, the ignition reducing composition can be added to the paper in an amount from about 1% to about 30% by weight of the paper within the banded region, and particularly from about 2% to about 20% by weight of the paper within the banded region after the bands have been formed and dried. Although not always the case, generally the amount of the composition applied to the paper will generally increase as the permeability of the paper increases. For instance, for wrapping papers having a permeability of less than about 30 Coresta units, the composition can be applied to a paper in an amount from about 1% to about 15% by weight. For wrapping papers having a permeability greater than about 60 Coresta units, on the other hand, the composition can be applied to the paper in an amount from about 8% to about 30% by weight.

Figure 4:
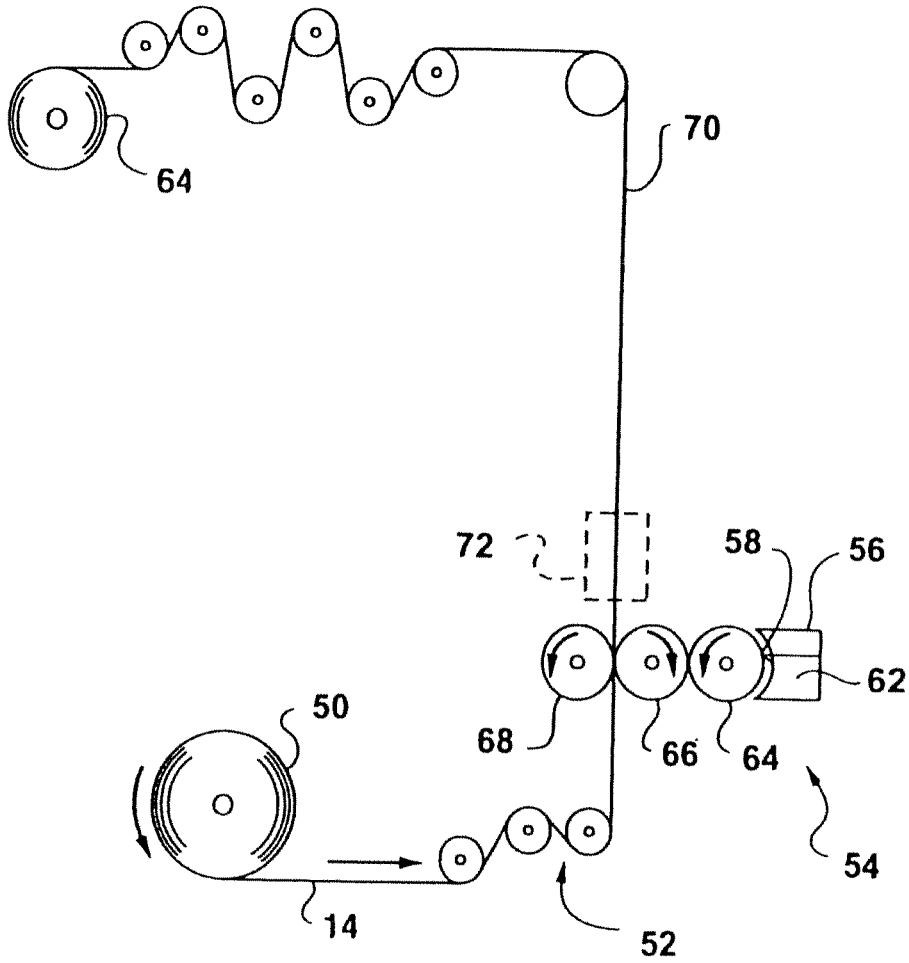
FIG. 4 is a system for treating a paper wrapper in accordance with the present disclosure.

As described above, the composition can be sprayed, brushed, or printed onto the wrapper. In general, any suitable printing process can be used in the present disclosure. Applicants have found that suitable printing techniques include gravure printing, or flexographic printing. In one embodiment, as illustrated in FIG. 4, a paper wrapper 14 is unwound from a supply roll 50 and travels in the direction indicated by the arrow associated therewith. Alternatively, the paper wrapper 14 may be formed by one or more paper-making processes and passed directly into the process without first being stored on a supply roll.

As shown in FIG. 4, the paper wrapper 14 passes through the nip of an S-roll arrangement 52 in a reverse-S path. From the S-roll arrangement 52, the paper wrapper 14 passes to a gravure printing arrangement 54. The gravure printing process may be a direct print process or an indirect print process, such as by using an offset printer. FIG. 4 depicts an indirect print process.

The gravure printing arrangement contains a composition tank 56 and a doctor blade 58 which is used to apply a composition 62 to a gravure roll 64.

The gravure roll 64 may be engraved with a conventional continuous cell pattern (e.g., quadrangular cell pattern) arranged in parallel bands across the width of the roll with nonengraved areas between each band. Each gravure cell holds a small amount of the composition which is released in a pattern onto a rubber applicator roll 66. The paper wrapper 14 passes through a nip between the rubber applicator roll 66 and a cooperating backup roll 68. The composition is transferred from the applicator roll 66 to the surface of the paper wrapper 14 thereby forming a coated paper 70. The speeds of the gravure roll 64 and the applicator roll 68 may be controlled so they are the same or so they differ by a minor amount to influence the application of the composition. Once the composition is applied to the paper wrapper 14, the paper wrapper can be dried if desired.

For instance, as shown in FIG. 4, after leaving the gravure printing arrangement 54, the paper web 14 is passed through a drying operation 72. During the drying operation 72, the treated paper can be dried using various devices and methods. For example, in one embodiment, the drying operation 72 includes a drying device that passes hot gas such as air over the paper web. The temperature of the air can range from about 100° F. to about 600° F. In an alternative embodiment, the drying device can be a steam can. After being treated with a composition by the gravure printing device, the paper web can be placed in contact with the steam can for drying the composition.

Besides drying the paper with a hot gas stream or with a steam can, in another embodiment of the present invention the paper can be dried by contacting the paper with infra-red rays. For example, in one embodiment, the paper can be passed under an infra-red heating lamp.

In still another alternative embodiment of the present invention, the paper web 14 can be simply air dried during the drying operation 72.

It should be understood that the process illustrated in FIG. 4 represents merely one embodiment for applying a composition to the paper wrapper. For instance, a greater amount of printing stations may be included at any location for applying the composition in a multi-pass process.

Once incorporated into a smoking article, paper wrappers made according to the present disclosure are well suited to reducing the ignition proclivity characteristics of the article. For instance, smoking articles made in accordance with the present disclosure can have an ASTM Test No. E2187-04 (Cigarette Extinction Test) pass rating of at least about 75%, such as at least about 80%, such as at least about 90%, such as even 100% pass rating. In addition, such smoking articles can also have a free air self-extinguishment (FASE) rating of less than about 50%, such as less than about 30%, such as less than about 20%, such as even less than about 10%.

The present disclosure may be better understood with reference to the following examples.

EXAMPLE NO. 1

The following tests were conducted to demonstrate the teachings of the present disclosure.

Various paper wrappers were made containing cellulosic fibers in combination with a filler. In this example, the filler comprised calcium carbonate.

During formation of the paper wrappers, an aqueous suspension containing the cellulosic fibers and the filler particles were deposited onto a foraminous surface. Water was drained through the foraminous surface using suction. The filler particles formed a concentration gradient through the thickness of the paper wrappers. In particular, a greater concentration of filler particles was present on the surface of the paper wrapper not in contact with the foraminous surface (hereinafter top surface). The opposite surface of the paper wrapper, or the bottom surface, was placed in contact with the foraminous surface and had a lower concentration of filler particles.

An ignition reducing composition was then applied to the paper wrappers in the form of bands. In certain embodiments, the bands were placed on the bottom surface of the paper. In other samples, however, the bands were placed on the top surface of the paper wrappers.

The paper wrappers were then wrapped around a column of tobacco filler. The paper wrappers and the smoking articles were tested for average band porosity, the band porosity coefficient of variation, and carbon monoxide delivery. The smoking articles were also tested according to ASTM Test No. E2187-04 and according to the FASE Test.

The following results were obtained:

| Side Printed | Bottom Surface | Top Surface |
|---|---|---|
| Avg. band porosity (CU) | 15.1 | 18.6 |
| Band porosity COV (%) | 28.1 | 20.7 |
| ASTM SE (%) | 95 | 100 |
| FASE SE (%) | 10 | 30 |
| CO (mg/cig.) | 16.2 | 15.1 |

In order to calculate the average band porosity and the band porosity coefficient of variation, 250 measurements were taken. As shown above, the samples treated on the top surface had a higher average band porosity and a lower band porosity coefficient of variation. Also, the top surface treated wrapping papers exhibited lower carbon monoxide delivery when incorporated into a smoking article.

EXAMPLE 2

The tests described in Example 1 were repeated. In this example, the paper wrappers again contained a calcium carbonate filler.

The paper wrappers were made as described in Example 1 so that the filler particles formed a concentration gradient throughout the thickness of the paper wrapper. The following results were obtained:

| Side Printed | Bottom Surface | Top Surface |
|---|---|---|
| Avg. band porosity (CU) | 21.2 | 25.3 |
| Band porosity COV (%) | 40.5 | 27.0 |

-continued

| Side Printed | Bottom Surface | Top Surface |
|---|---|---|
| ASTM SE (%) | 85 | 90 |
| FASE SE (%) | 20 | 10 |
| CO (mg/cig.) | 14.7 | 13.8 |

As shown above, paper wrappers treated on the top surface had a higher average band porosity and a lower band porosity coefficient of variation. Also, CO delivery was reduced from about 5% to about 10%. Due to the more uniform bands, the smoking articles including the top surface treated wrappers also performed better with respect to the self-extinguishment test and the FASE Test.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A paper wrapper for a smoking article comprising cellulose fibers and filler particles, the paper wrapper including a first exterior surface and a second interior and opposite surface, the filler particles forming a concentration gradient over a thickness of the paper wrapper such that a greater concentration of filler particles is present at the first exterior surface in comparison to the concentration of filler particles present at the second interior surface, the first exterior surface being smoother than the second interior surface, the first exterior surface having a Sheffield smoothness of less than about 500;

wherein greater than about 65% by weight of the filler particles are contained in the paper wrapper between a middle of the wrapper and the first exterior surface; and at least one treated area located on the first exterior surface of the paper wrapper, the treated area comprising an ignition reducing composition, the treated area reducing the ignition proclivity characteristics of a smoking article incorporating the paper wrapper, the treated area having a porosity coefficient of variation of less than about 27%.

2. A paper wrapper as defined in claim 1, wherein the smoking article includes a plurality of treated areas located on the first surface of the paper wrapper, the treated areas being separated by untreated areas.

3. A paper wrapper as defined in claim 1, wherein the ignition reducing composition comprises an alginate.

4. A paper wrapper as defined in claim 1, wherein the treated areas have a porosity coefficient of variation of less than about 20%.

5. A paper wrapper as defined in claim 1, wherein the paper wrapper comprises a wet-laid paper web formed on a foraminous surface and wherein the second surface faces the foraminous surface during formation of the paper web.

6. A paper wrapper as defined in claim 1, wherein the wrapper contains the filler particles in an amount from about 20% to about 40% by weight, and wherein the treated area has a Burn Mode Index of less than about 5 $cm^{-1}$.

7. A paper wrapper as defined in claim 1, wherein the ignition reducing composition comprises guar gum, pectin, polyvinyl acetate, a cellulose derivative, starch, a starch derivative, or mixtures thereof.

* * * * *